US005146966A

United States Patent [19]

Romano

[11] Patent Number: 5,146,966

[45] Date of Patent: Sep. 15, 1992

[54] HOOP-SHAPED HANDBAG

[75] Inventor: Michael Romano, Wakefield, Mass.

[73] Assignee: MPJ Manufacturing Company, Inc., Marlboro, Mass.

[21] Appl. No.: 822,355

[22] Filed: Jan. 17, 1992

[51] Int. Cl.[5] ..... A45C 3/00

[52] U.S. Cl. ..... 150/110; 150/130; 383/28; 383/29; D3/42; D9/305

[58] Field of Search ..... 150/100, 110, 130; 383/22, 24, 28, 29, 907; D3/42, 50; D9/305

[56] References Cited

U.S. PATENT DOCUMENTS

| | | | |
|---|---|---|---|
| D. 110,184 | 6/1938 | Lobel | D3/50 |
| D. 129,839 | 10/1941 | Nachmias | D3/50 |
| D. 144,458 | 4/1946 | Hiltenbrand | D3/50 |
| D. 262,587 | 1/1982 | Hyers | D3/50 |
| 2,664,131 | 12/1953 | Miller | 383/29 |
| 3,108,627 | 10/1963 | Tatelman | 150/110 |
| 3,425,470 | 2/1969 | Wuest | 150/110 |
| 4,267,869 | 5/1981 | Behar | D3/42 |
| 4,561,480 | 12/1985 | Underwood et al. | 383/907 |

FOREIGN PATENT DOCUMENTS

| | | | |
|---|---|---|---|
| 2633763 | 2/1978 | Fed. Rep. of Germany | 383/29 |
| 555124 | 6/1923 | France | 150/110 |
| 287309 | 3/1928 | United Kingdom | 150/110 |

*Primary Examiner*—Gary E. Elkins
*Attorney, Agent, or Firm*—Lorusso & Loud

[57] ABSTRACT

A handbag formed by attaching a pouch along the periphery of a portion of a continuous circular hoop in such a way that the portion of the hoop covered by the pouch serves as the frame for the bag portion of the handbag and the remaining portion of the hoop serves as a handle for carrying the handbag.

4 Claims, 4 Drawing Sheets

HOOP-SHAPED HANDBAG

The invention relates to handbags, and in particular to handbags used to carry various items to the beach, to the ski lodge, to school, for travel or for everyday use. It is desirable to provide a bag that is easy to carry, light-weight, sturdy, easy to access, and which is easy and inexpensive to manufacture.

There are a variety of bags in existence which seek to provide some or all of those features. For example, U.S. Patent Des. 129,839 shows a bag in which the handles are formed as an extension of the frame. This feature provides some advantages in that it is efficient to form the handles and frame from the same member. There are, however, a number of drawbacks associated with the design. First, the frames extend along the tops and sides of the handbag, but do not support the bottom of the bag where the most support is required. An additional piece is required on the bottom to which the fabric must be attached. In addition the frame is constructed of two separate members. The construction is elaborate, and may not provide adequate support.

Thus, it is an object of the present invention to provide a handbag which is easy to construct and requires a minimum of materials.

It is another object of the present invention to provide a bag which will carry various items that does not require a closure device.

It is another object of the present invention to provide a handbag that can be carried either on the shoulder or by hand.

It is another object of the present invention to provide a handbag that is sturdy, easy to manufacture and easy to carry.

SUMMARY OF THE INVENTION

The invention achieves the objectives set forth above by providing a handbag formed by attaching a pouch along the periphery of a portion of a continuous circular hoop in such a way that the portion of the hoop covered by the pouch serves as the frame for the bag portion of the handbag and the remaining portion of the hoop serves as a handle for carrying the handbag. Thus, the novelty of the invention lies in the fact that a single member serves as both the frame and the handle for the handbag, thereby making the handbag extremely easy and inexpensive to manufacture. When the pouch is positioned on the hoop, the opening extends across the hoop. The opening is wide enough to provide easy access to the contents of the bag, yet narrow enough so that the contents will not easily spill out. This eliminates the need for a closure device which can be inconvenient to use and expensive to manufacture.

DETAILED DESCRIPTION OF THE PREFERRED EMBODIMENT

Figure 1:
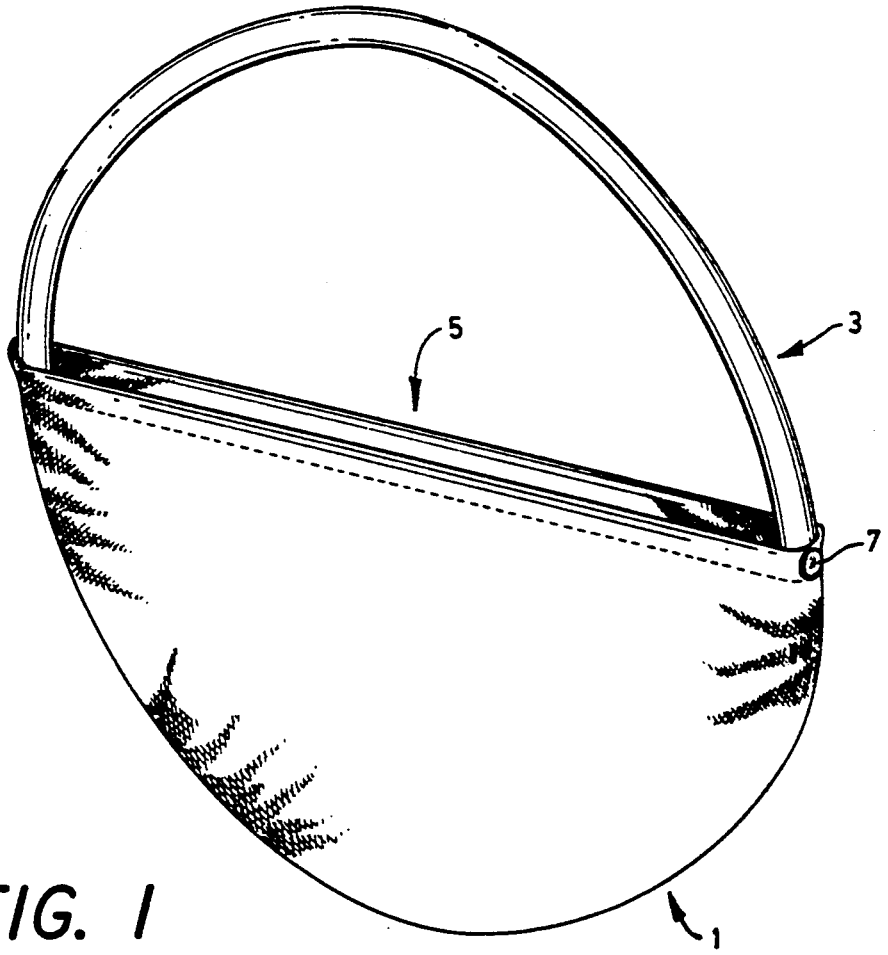
FIG. 1 is a perspective view of the hoop shaped handbag of the claimed invention.
Figure 3:
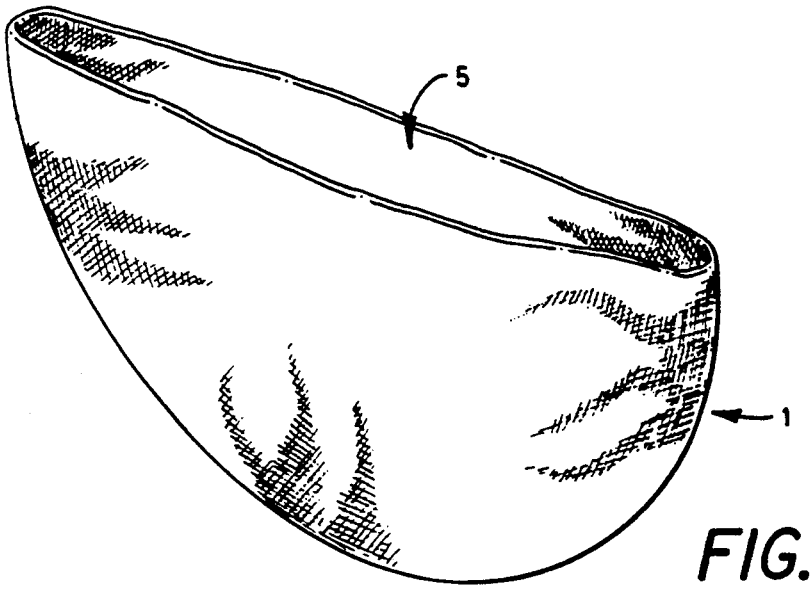
FIG. 3 is a perspective view of the pourch.
Figure 4:
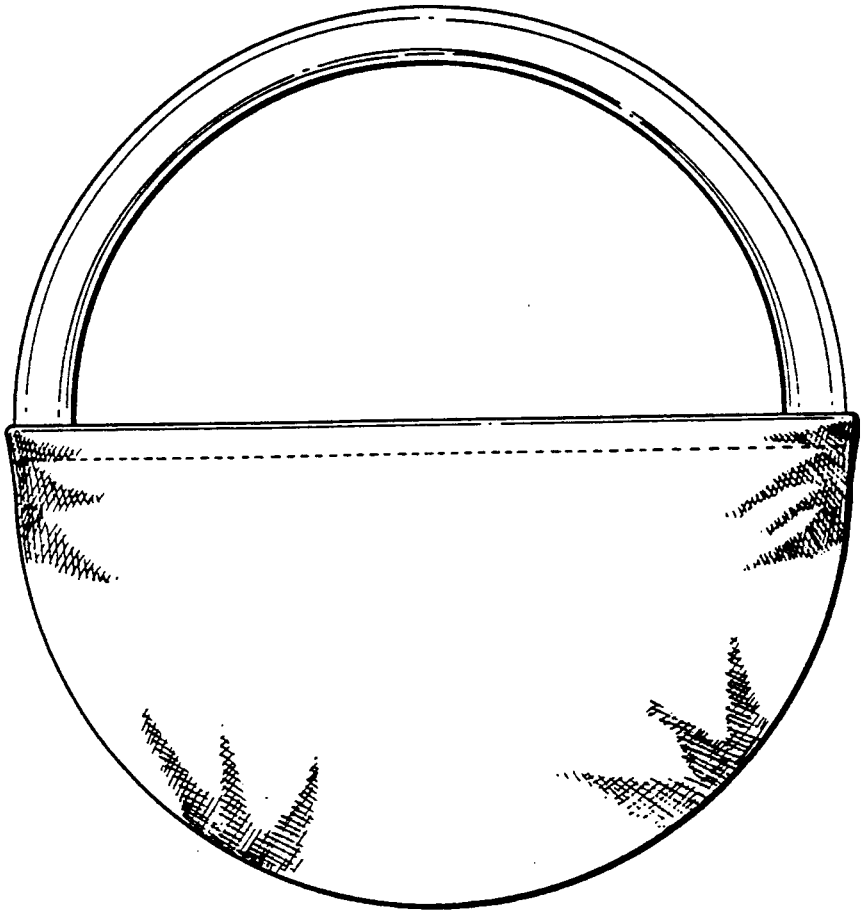
FIG. 4 is a front view of the hoop shaped handbag.

Reference is made to FIG. 1 which shows a perspective view of the preferred embodiment of the handbag according to the present invention. The handbag is formed by attaching a pouch 1, as shown in FIG. 3, along the periphery of a portion of a continuous circular hoop 3 in such a way that the portion of the hoop 3 covered by the pouch 1 serves as the frame for the pouch 1 and the remaining portion serves as the handle for carrying the handbag. FIG. 4 shows a front view of the handbag.

The pouch 1 is shown in FIG. 3. It is semicircular in shape, is closed along the circular sides and has an opening at its top 5. It is sized so that when it is pulled over the periphery of the hoop 3, it fits snugly. Rivets 7 may be used to attach the pouch 1 to the hoop 3. The pouch 1 may be constructed from any fabric suitable for carrying items.

Figure 2:
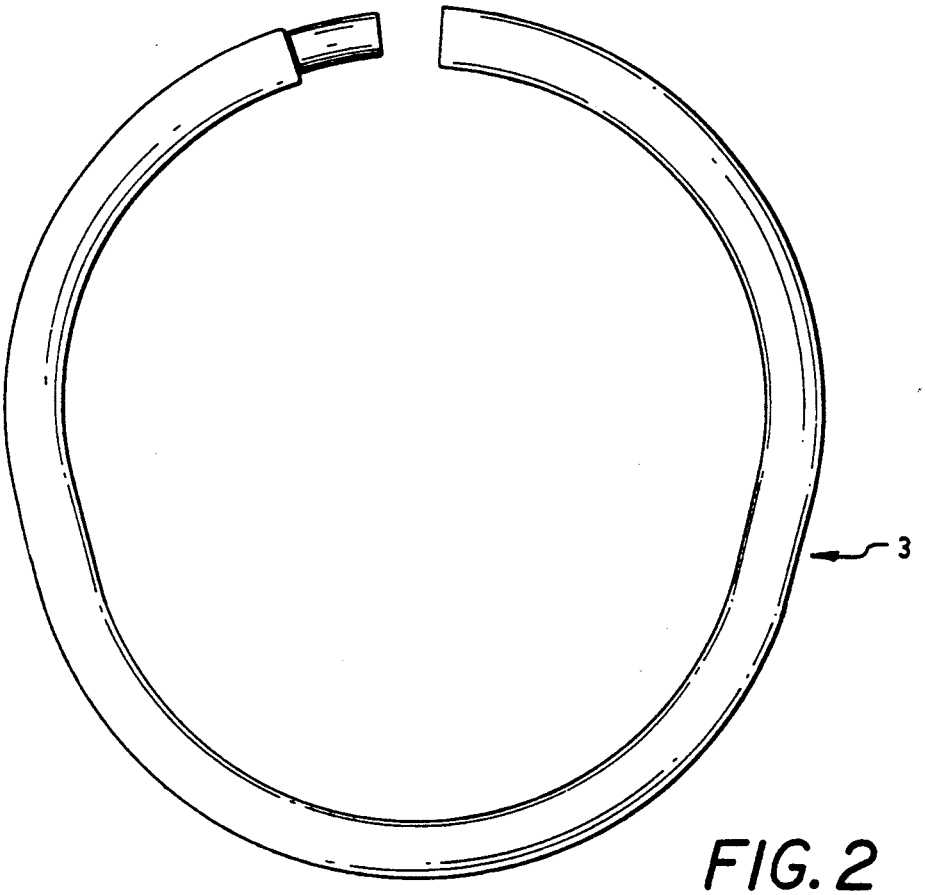
FIG. 2 shows the tubular member used to form the hoop.
Figure 5:
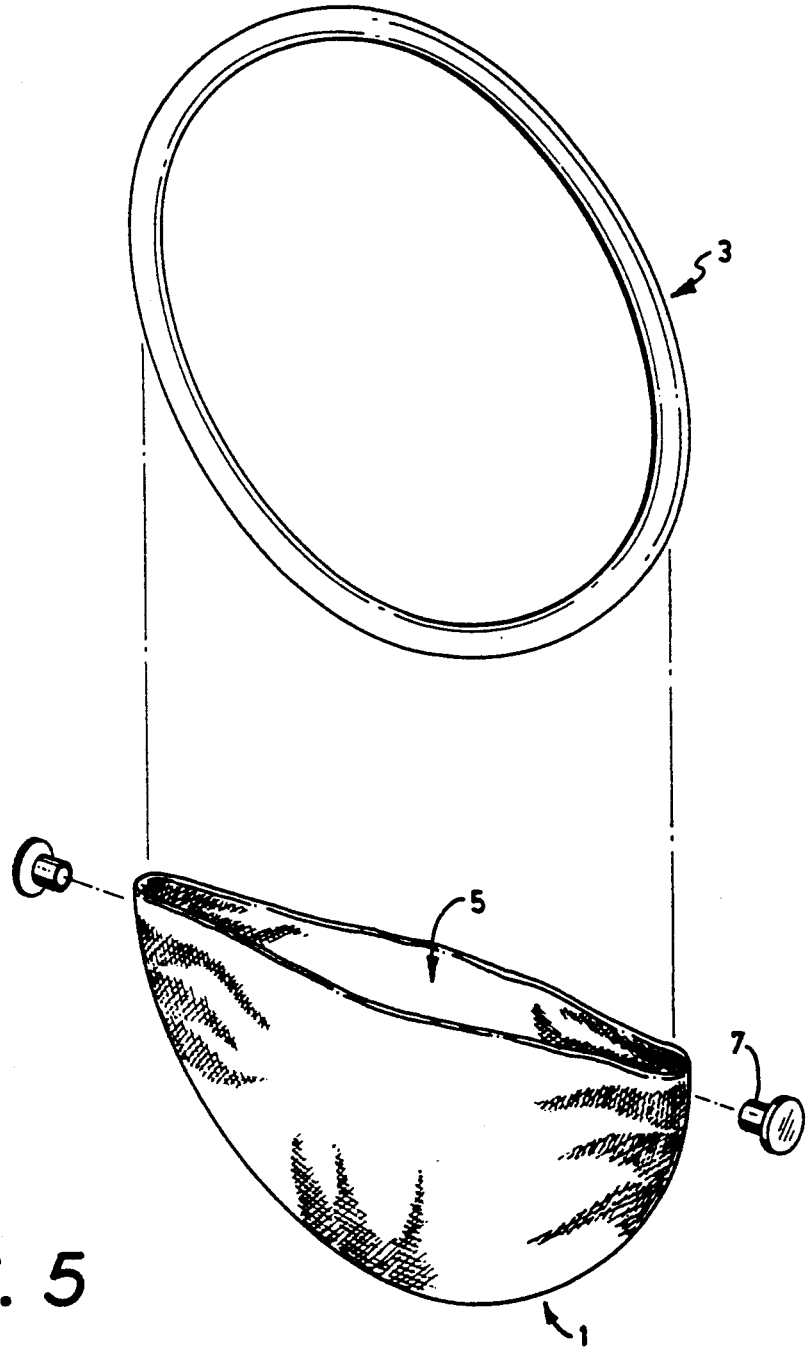
FIG. 5 is an exploded view showing the hoop and the pouch.

The hoop 3 is comprised of a hollow tubular member adapted to be joined at both ends to form a continuous hoop, as shown in FIG. 2. In order to construct the handbag, the tubular member is joined at both ends to form the continuous hoop 3. In the preferred embodiment, the pouch 1 is pulled onto the hoop 3 so that it covers slightly more than half of the hoop 3. FIG. 5 shows an exploded view of the hoop 3 and the pouch 1.

Since the pouch 1 covers only slightly more than half of the hoop 3, an opening 5 is formed that extends across almost the entire diameter of the hoop. If the pouch 1 covered more of the periphery, the opening 5 would be narrow and it would be more difficult to reach the contents of the pouch. When the handbag is manufactured according to the invention, the opening of the pouch is wide enough to provide easy access to the contents of the bag, yet narrow enough so that the contents will not easily spill out This eliminates the need for a closure device which can be difficult to use and expensive to manufacture. In addition, with the pouch 1 covering only slightly more than half of the hoop 3, there is plenty of room for the remaining portion of the frame to serve as a handle. In this way the handbag can be carried on the shoulder, if desired. If the pouch 1 covered more of the hoop 3, less of the hoop 3 would be available for the handle and it might not be possible to use the handbag as a shoulder bag.

While the foregoing has been described with reference to its preferred embodiment, it should not be limited to its embodiment since alterations and modifications will occur to those skilled in the art. For example, the pouch may cover exactly half of the hoop or slightly less than half of the hoop. In addition, various fabrics may be used for the pouch depending upon the desired result. In the summer for the beach, a light weight fabric may be preferred. Finally, a closure device may be included to close the pouch portion.

What is claimed is:

1. A hoop shaped handbag comprising:

a tubular member joined at both ends to form a continuous circular hoop;

a pouch surrounding a portion of a periphery of the circular hoop having an opening that extends across the hoop, wherein the surrounded portion of the hoop forms a frame for the pouch and the remaining portion of the hoop forms a handle for carrying the handbag.

2. The handbag according to claim 1, wherein the pouch is attached to the hoop with rivets.

3. The bag of claim 1, wherein the pouch covers slightly more than half of the periphery of the hoop.

4. The bag of claim 1, wherein the pouch covers half of the periphery of the hoop.

* * * * *

UNITED STATES PATENT AND TRADEMARK OFFICE

CERTIFICATE OF CORRECTION

PATENT NO. : 5,146,966
DATED : September 15, 1992
INVENTOR(S) : Michael Romano

It is certified that error appears in the above-indentified patent and that said Letters Patent is hereby corrected as shown below:

Title page, item
[56] References Cited, under the heading "U.S. Patent Documents" please insert the following:

| | | |
|---|---|---|
| --1,771,168 | 1/1930 | Droutman |
| D45355 | 3/1914 | Saart |
| 4,095,636 | 6/1978 | Urion et al. |
| D191,604 | 10/1961 | Cohen |
| 1,478,972 | 11/1923 | Prahar-- |

Col. 2, Claim 1, line 2, delete "both"; same line, after "ends" insert --of said tubular member--; same line, delete "a" (second occurrence) and insert --only one--.

Signed and Sealed this
Nineteenth Day of July, 1994

Bruce Lehman

*Attest:*

*Attesting Officer*

BRUCE LEHMAN
*Commissioner of Patents and Trademarks*